US010098513B1

(12) United States Patent
Robinson

(10) Patent No.: US 10,098,513 B1
(45) Date of Patent: Oct. 16, 2018

(54) TOILET SEAT AND LID LIFTER

(71) Applicant: Barrion Robinson, Pampano Beach, FL (US)

(72) Inventor: Barrion Robinson, Pampano Beach, FL (US)

( * ) Notice: Subject to any disclaimer, the term of this patent is extended or adjusted under 35 U.S.C. 154(b) by 0 days.

(21) Appl. No.: 15/682,737

(22) Filed: Aug. 22, 2017

(51) Int. Cl.

| | |
|---|---|
| ***A47K 13/14*** | (2006.01) |
| ***A47K 13/10*** | (2006.01) |
| ***A47K 13/24*** | (2006.01) |
| ***E03D 5/08*** | (2006.01) |

(52) U.S. Cl.
CPC ..... *A47K 13/105* (2013.01); *A47K 13/24* (2013.01); *E03D 5/08* (2013.01)

(58) Field of Classification Search
CPC ..... A47K 13/105; A47K 13/24
USPC ..... 4/246.1, 246.3
See application file for complete search history.

(56) References Cited

U.S. PATENT DOCUMENTS

| | | | | |
|---|---|---|---|---|
| 4,736,470 | A | 4/1988 | Classon | |
| 4,807,307 | A | 2/1989 | Sato | |
| 5,056,165 | A * | 10/1991 | Wescott, Sr. | A47K 13/10 4/246.1 |
| D349,952 | S | 8/1994 | Evans | |
| 5,488,743 | A | 2/1996 | Alfonso | |
| 6,651,262 | B1 | 11/2003 | Tinsley | |
| 6,807,687 | B2 | 10/2004 | Marras | |
| 6,907,621 | B2 | 6/2005 | Stemen | |
| 6,968,579 | B1 | 11/2005 | Feinberg | |
| 7,254,846 | B2 | 8/2007 | Kim | |
| 8,214,933 | B1 | 7/2012 | Gaudin | |
| D782,633 | S * | 3/2017 | Reisinger | D23/309 |

FOREIGN PATENT DOCUMENTS

| | | |
|---|---|---|
| GB | 2481222 A | 12/2011 |

* cited by examiner

*Primary Examiner* — Huyen Le
(74) *Attorney, Agent, or Firm* — Kyle A. Fletcher, Esq.

(57) ABSTRACT

The toilet seat and lid lifter is a mechanical apparatus that is configured to: 1) lift a toilet seat and a toilet lid; and, 2) flush a toilet. The toilet seat and lid lifter comprises a cover, a lifting mechanism, and a flush mechanism. The lifting mechanism is a pedal operated mechanical apparatus that allows the toilet seat and the toilet lid to be lifted without the use of the hands. The lifting mechanism will lower the toilet seat and the toilet lid to their original positions after use. The flush mechanism is a pedal operated mechanical apparatus that: 1) attaches to the flush handle of the toilet; and, 2) operates the flush handle without the use of the hands.

17 Claims, 6 Drawing Sheets

TOILET SEAT AND LID LIFTER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal or domestic articles including sanitary equipment, more specifically, an apparatus for raising and lowering toilet seats.

SUMMARY OF INVENTION

The toilet seat and lid lifter is a mechanical apparatus that is configured to: 1) lift a toilet seat and a toilet lid; and, 2) flush a toilet. The toilet seat and lid lifter comprises a cover, a lifting mechanism, and a flush mechanism. The lifting mechanism is a pedal operated mechanical apparatus that allows the toilet seat and the toilet lid to be lifted without the use of the hands. The lifting mechanism will lower the toilet seat and the toilet lid to their original positions after use. The flush mechanism is a pedal operated mechanical apparatus that: 1) attaches to the flush handle of the toilet; and, 2) operates the flush handle without the use of the hands.

These together with additional objects, features and advantages of the toilet seat and lid lifter will be readily apparent to those of ordinary skill in the art upon reading the following detailed description of the presently preferred, but nonetheless illustrative, embodiments when taken in conjunction with the accompanying drawings.

In this respect, before explaining the current embodiments of the toilet seat and lid lifter in detail, it is to be understood that the toilet seat and lid lifter is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toilet seat and lid lifter.

It is therefore important that the claims be regarded as including such equivalent construction insofar as they do not depart from the spirit and scope of the toilet seat and lid lifter. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

Figure 1:
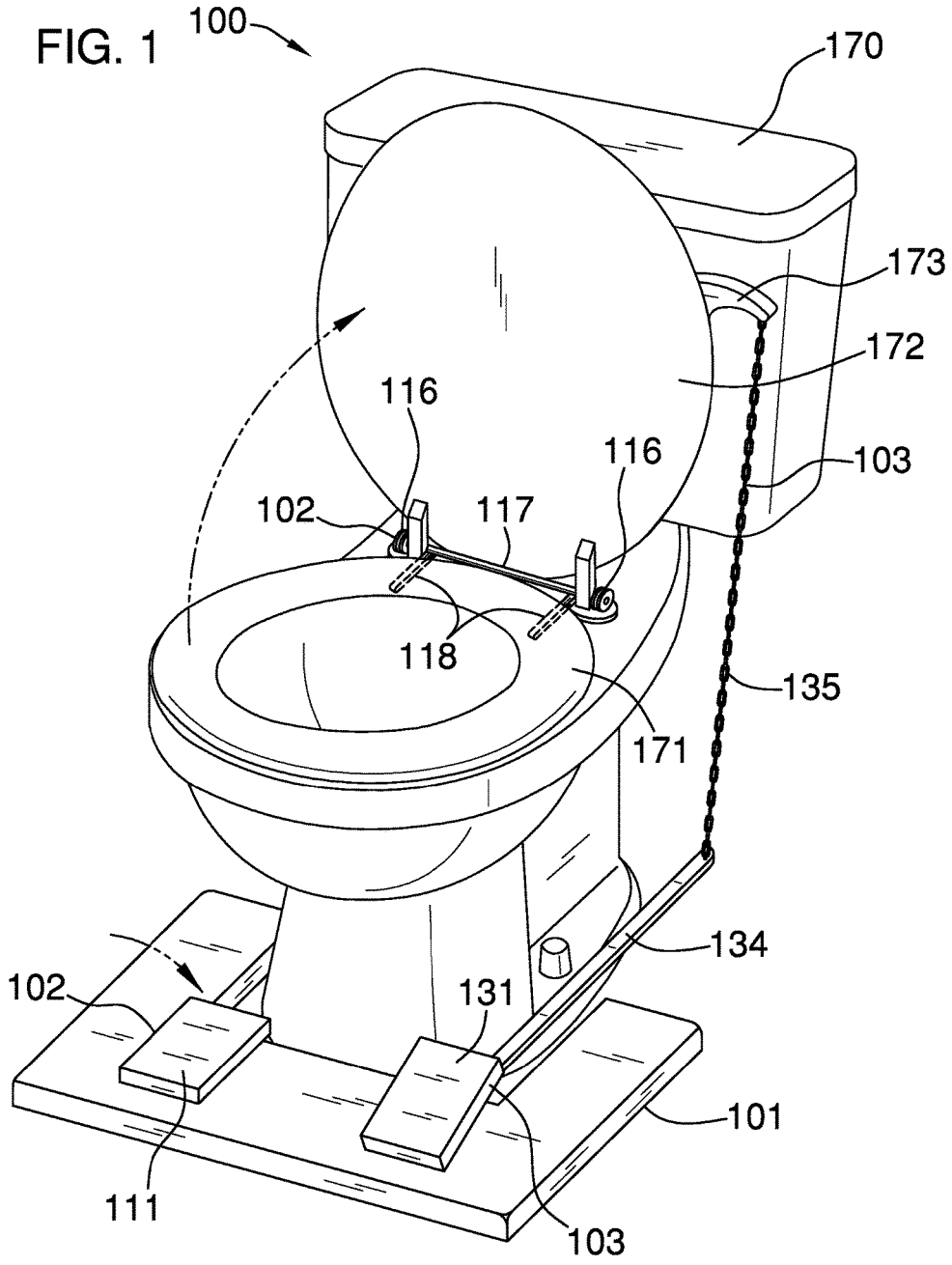
FIG. 1 is a perspective view of an embodiment of the disclosure.
Figure 2:
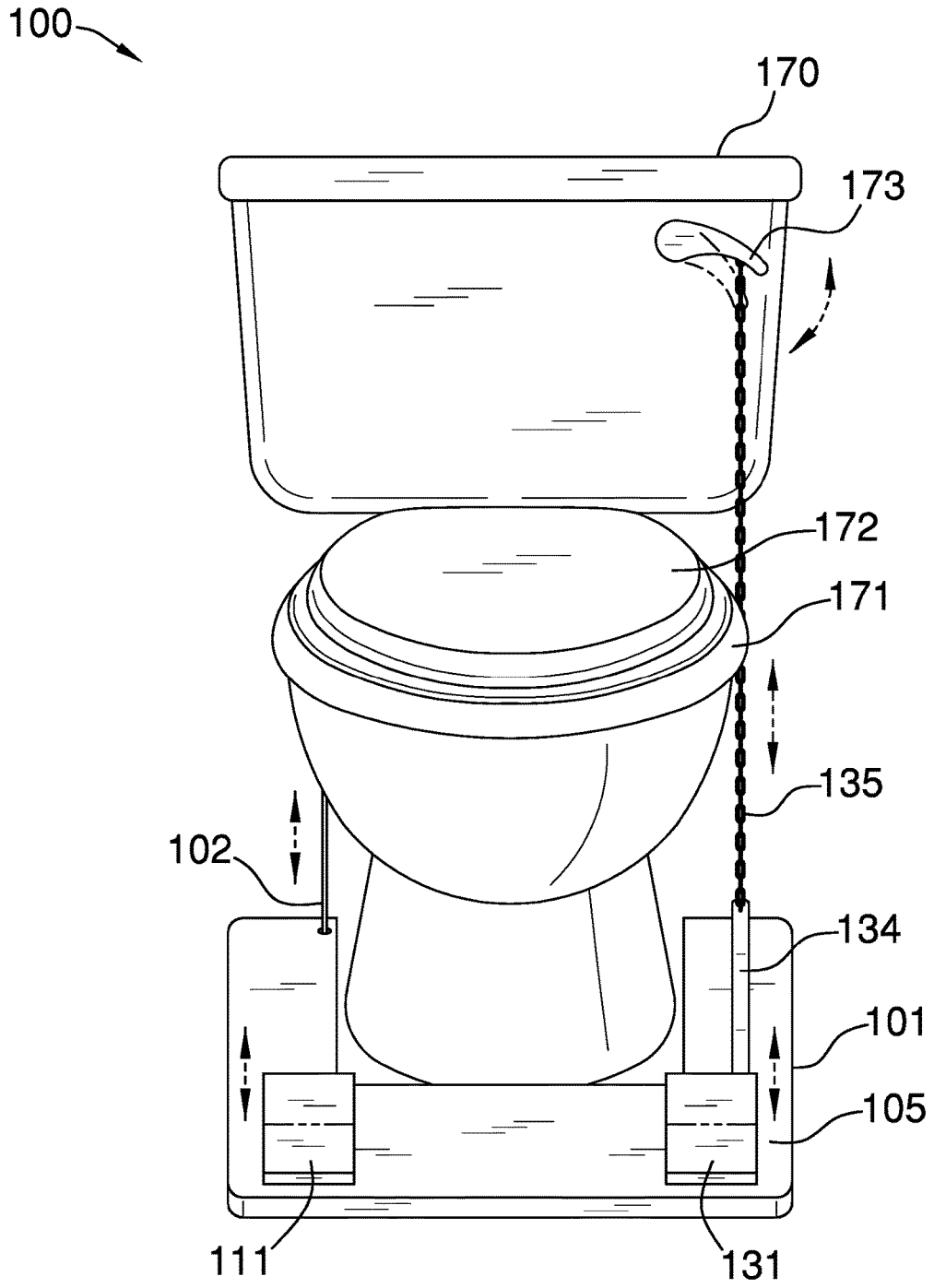
FIG. 2 is a front view of an embodiment of the disclosure.
Figure 3:
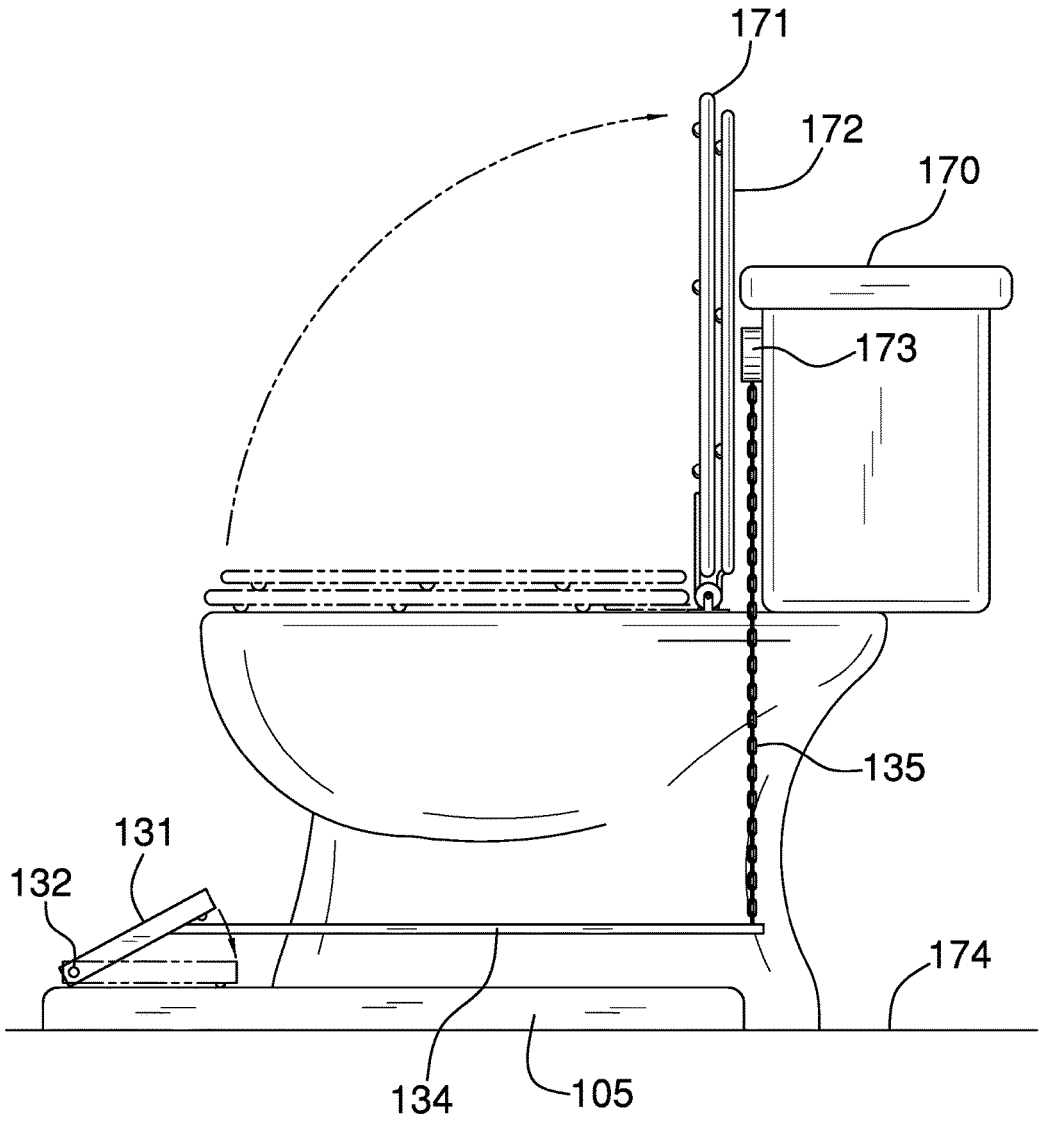
FIG. 3 is a side view of an embodiment of the disclosure.
Figure 4:
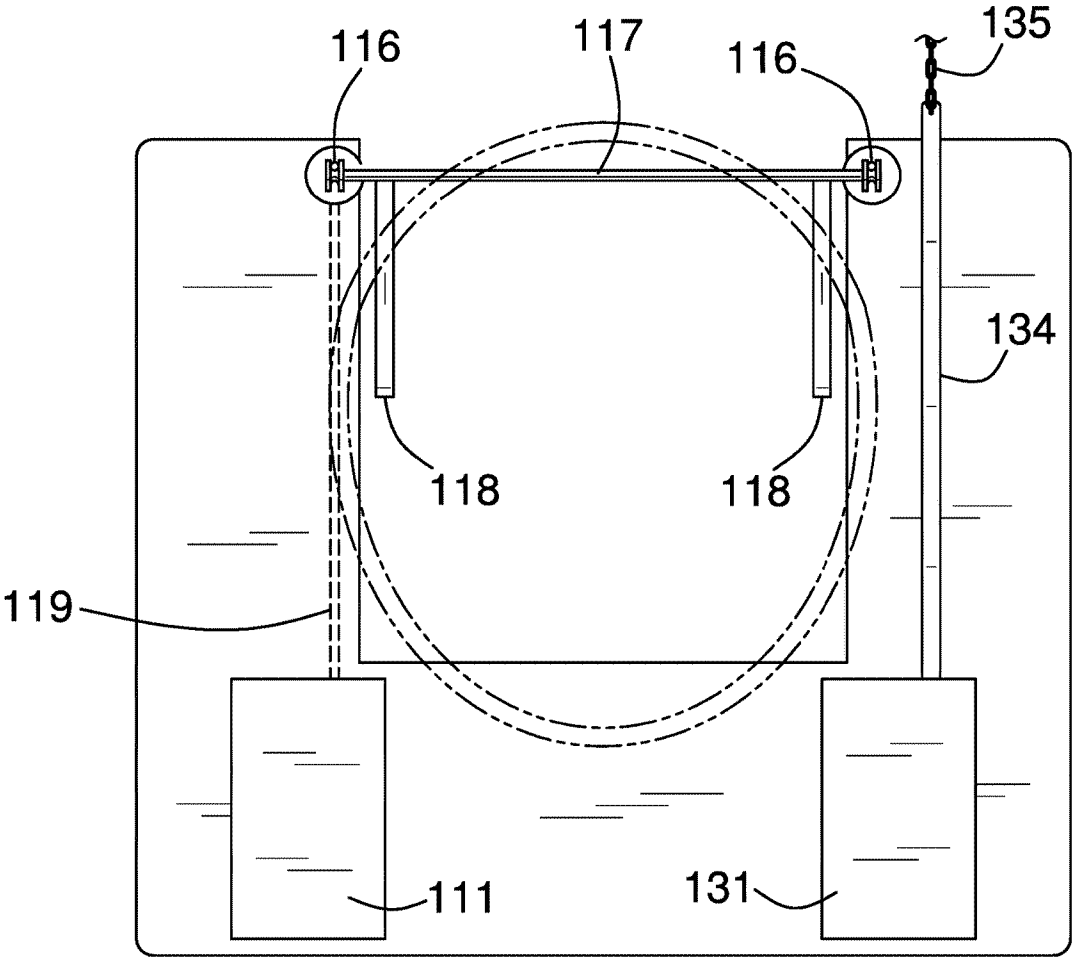
FIG. 4 is a top view of an embodiment of the disclosure.
Figure 5:
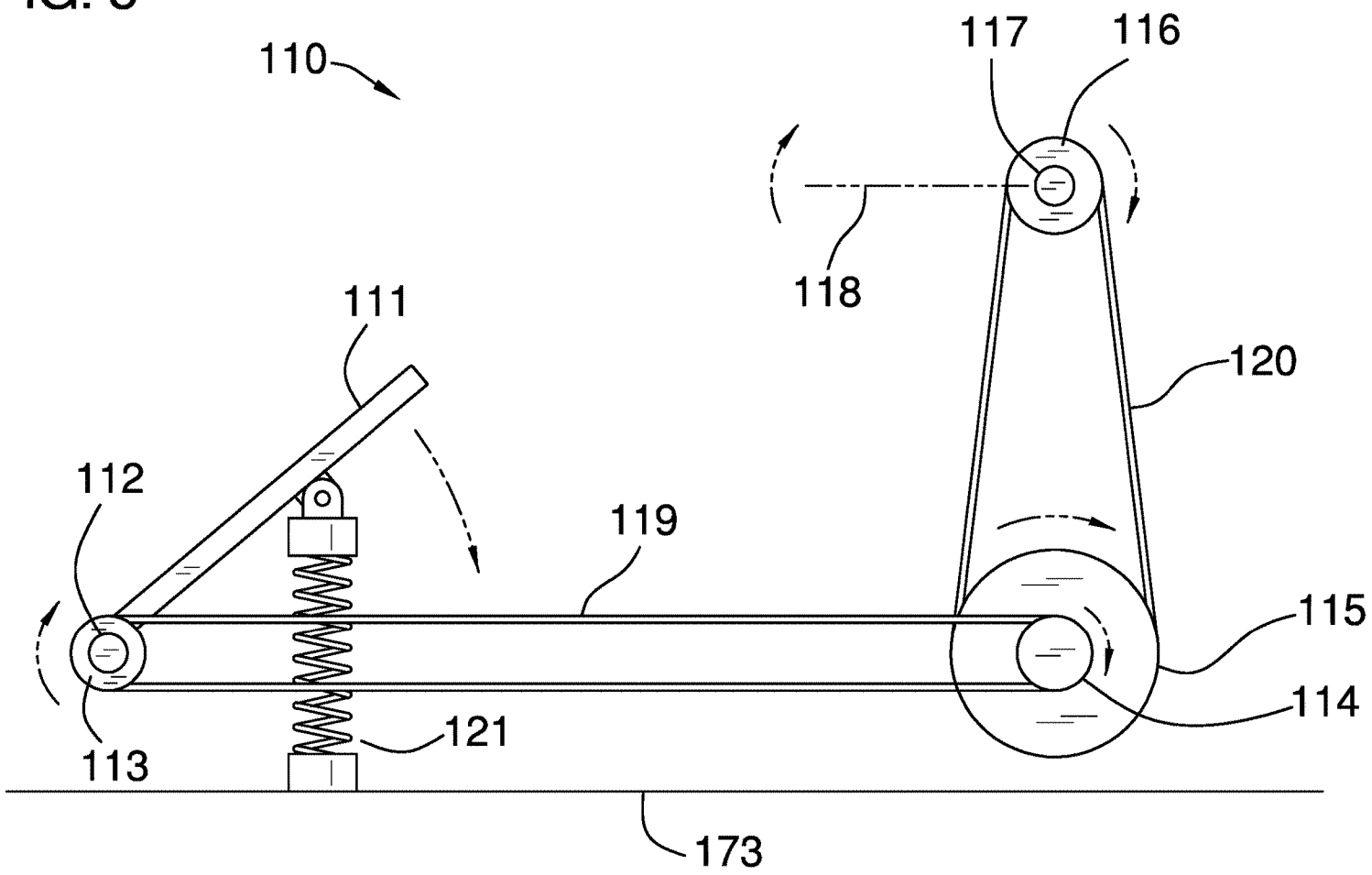
FIG. 5 is a detailed side schematic view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The toilet seat and lid lifter 100 (hereinafter invention) is a mechanical apparatus that is configured to: 1) lift a toilet seat 171 and a toilet lid 172; and, 2) flush a toilet 170. The toilet 170 is further defined with a toilet seat 171, a toilet lid 172, and a flush handle 173. The invention 100 comprises a cover 101, a lifting mechanism 102, and a flush mechanism 103. The lifting mechanism 102 is a pedal operated mechanical apparatus that allows the toilet seat 171 and the toilet lid 172 to be lifted without the use of the hands. The lifting mechanism 102 will lower the toilet seat 171 and the toilet lid 172 to their original positions after use. The flush mechanism 103 is a pedal operated mechanical apparatus that: 1) attaches to the flush handle 173 of the toilet 170; and, 2) operates the flush handle 173 without the use of the hands.

The cover 101 is a shell that is mounted around the base of the toilet 170. The cover 101 protects the lifting mechanism 102 from being stepped upon once the invention 100 is installed. The floor panel 105 is a hollow plate structure that is formed to wrap around the toilet 170. The floor panel 105 forms a protective shell within which is stored a portion the lifting mechanism 102 for the purpose of protecting the lifting mechanism 102 from damage. The floor panel 105 forms a protective shell within which is stored a portion the flush mechanism 103 for the purpose of protecting the flush mechanism 103 from damage.

The lifting mechanism 102 is a mechanical apparatus that raises and lowers the toilet seat 171 and the toilet lid 172. The lifting mechanism 102 comprises a first pedal 111, a first pedal pivot 112, a first pedal pulley 113, a transfer pulley 114, a drive pulley 115, an axle pulley 116, an axle pivot 117, a plurality of lifting levers 118, a first belt 119, a second belt 120, and a first compression spring 121.

The first pedal 111 is a foot-operated lever. The movement of the first pedal 111 provides the motive force that operates the lifting mechanism 102. By returning the first pedal 111 to the original position, the toilet seat 171 or the toilet lid 172 is also returned to its original position.

The first pedal pivot 112 is a readily and commercially available cylindrical shaft. The movement of the first pedal 111 rotates the first pedal pivot 112 using the center axis of the first pedal pivot 112 as the center of rotation. The first pedal pulley 113 is a readily and commercially available pulley that is attached to an end of the first pedal pivot 112 such that the rotation of the first pedal pivot 112 will rotate the first pedal pulley 113.

The transfer pulley 114 is a readily and commercially available pulley that is rotated by the first belt 119. The drive pulley 115 is a readily and commercially available pulley that is that is attached to the transfer pulley 114 such that the rotation of the drive pulley 115 will rotate the transfer pulley 114.

The axle pivot 117 is a readily and commercially available cylindrical shaft. The movement of the axle pulley 116 rotates the axle pivot 117. The axle pulley 116 is a readily and commercially available pulley that is that is attached to an end of the axle pivot 117 such that the rotation of the axle pulley 116 will rotate the axle pivot 117 using the center axis of the axle pivot 117 as the center of rotation.

Each of the plurality of lifting levers 118 is a strut that projects perpendicularly away from the axle pivot 117. Each of the plurality of lifting levers 118 attaches the toilet seat 171 such that the rotation of the axle pivot 117 will raise or lower the object The first belt 119 is a cord that is formed into a loop that loops around the first pedal pulley 113 and the transfer pulley 114 such that the rotation of the first pedal pulley 113 will rotate the transfer pulley 114. The second belt 120 is a cord that is formed into a loop that loops around the drive pulley 115 and the axle pulley 116 such that the rotation of the drive pulley 115 will rotate the axle pulley 116.

The first compression spring 121 is a readily and commercially available helical coil compression spring that is placed underneath the first pedal 111 for the purpose of returning the first pedal 111 to its original position after the foot is removed from the first pedal 111.

The lifting mechanism 102 is assembled as described in the following 6 paragraphs The first pedal 111 is mounted on the first pedal pivot 112 such that when the first pedal 111 is stepped on the motion of the first pedal 111 will rotate the first pedal pivot 112. The first pedal pulley 113 is mounted in a fixed manner to the first pedal pivot 112. The first pedal pulley 113 is mounted to the first pedal pivot 112 such that the rotation of the first pedal pivot 112 will rotate the first pedal pulley 113 in the same rotational direction as the first pedal pivot 112.

Each of the plurality of lifting levers 118 are attached in a fixed manner to the axle pivot 117 such that the rotation of the axle pivot 117 will cause the plurality of lifting levers 118 to rotate. Each of the plurality of lifting levers 118 is attached to the toilet seat 171. Each of the plurality of lifting levers 118 is attached to the toilet seat 171 such that the toilet seat 171 will rotate when the axle pivot 117 is rotated. The rotation of the toilet seat 171 results in the lifting and lowering of both the toilet seat 171 and the toilet lid 172. The axle pulley 116 is mounted in a fixed manner to the axle pivot 117. The axle pulley 116 is mounted to the axle pivot 117 such that the rotation of the axle pivot 117 will rotate the axle pulley 116 in the same rotational direction as the axle pivot 117.

The first belt 119 attaches the first pedal pulley 113 to the transfer pulley 114 such that the rotation of the first pedal pulley 113 will rotate the transfer pulley 114. If the first belt 119 is crossed between the first pedal pulley 113 and the transfer pulley 114 the transfer pulley 114 will rotate in the opposite direction of the first pedal pulley 113. If the first belt 119 is not crossed between the first pedal pulley 113 and the transfer pulley 114 the transfer pulley 114 will rotate in the same direction as the first pedal pulley 113.

The second belt 120 attaches the axle pulley 116 to the drive pulley 115 such that the rotation of the axle pulley 116 will rotate the drive pulley 115. If the second belt 120 is crossed between the axle pulley 116 and the drive pulley 115 the drive pulley 115 will rotate in the opposite direction of the axle pulley 116. If the second belt 120 is not crossed between the axle pulley 116 and the drive pulley 115 the drive pulley 115 will rotate in the same direction as the axle pulley 116.

The drive pulley 115 attaches to the transfer pulley 114 such that the rotation of the transfer pulley 114 will rotate the drive pulley 115 in the direction of the transfer pulley 114. The drive pulley 115 and the transfer pulley 114 are mounted on a stand. Methods to mount pulleys to stands are well known and documented in the mechanical arts.

The first compression spring 121 is mounted between the first pedal 111 and the supporting surface 174 upon which the toilet 170 is placed such that the first compression spring 121 will return the first pedal 111 to its original position once the foot is removed from the first pedal 111.

The operation of the lifting mechanism 102 is described in the following two paragraphs.

The motion of the first pedal 111 towards the supporting surface 174 rotates the first pedal pivot 112, which in turn rotates the first pedal pulley 113. The motion of the first pedal 111 towards the supporting surface 174 further cause the first compression spring 121 to be depressed which stores mechanical energy within the first compression spring 121. The energy of the rotation of the first pedal pulley 113 is transferred to the transfer pulley 114 through the first belt 119 such that the rotation of the first pedal pulley 113 causes the transfer pulley 114 to rotate as described elsewhere in this disclosure. The rotation of the transfer pulley 114 causes the drive pulley 115 to rotate. The energy of the rotation of the drive pulley 115 is transferred to the axle pulley 116 through the second belt 120 such that the rotation of the drive pulley 115 causes the axle pulley 116 to rotate as described elsewhere in this disclosure. The rotation of the axle pulley 116 causes the axle pivot 117 to rotate. The rotation of the axle pivot 117 causes the plurality of lifting levers 118 to rotate which in turn causes both the toilet seat 171 and the toilet lid 172 to be lifted.

When the force causing the motion of the first pedal 111 towards the supporting surface 174 is removed, the energy stored within the first compression spring 121 is released causing the first compression spring 121 to its relaxed state. As the first compression spring 121 returns to its relaxed state, the energy released by the first compression spring 121 causes the above actions to be reversed thereby lowering both the toilet seat 171 and the toilet lid 172.

The flush mechanism 103 is a mechanical apparatus that operates the flush handle 173 of the toilet 170. The flush mechanism 103 comprises a second pedal 131, a second pedal pivot 132, a second compression spring 133, a cantilever 134, and a flush chain 135. The cantilever 134 is further defined with a fixed end 143 and a free end 144. The flush chain 135 is further defined with a first end 141 and a second end 142.

The second pedal 131 is a foot-operated lever. The movement of the second pedal 131 provides the motive force that operates the flush mechanism 103. By returning the second pedal 131 to the original position, the tensile forces on the flush chain 135 are relaxed.

The second pedal pivot 132 is a readily and commercially available cylindrical shaft. The second pedal 131 is mounted on the second pedal pivot 132 such that when the second pedal 131 is stepped on the second pedal 131 will rotate around the second pedal pivot 132.

The second compression spring 133 is a readily and commercially available helical coil compression spring that is placed underneath the second pedal 131 for the purpose of returning the second pedal 131 to its original position after the foot is removed from the second pedal 131.

The cantilever 134 is a rigid shaft that projects away from the second pedal 131 such that the cantilever 134 is parallel to the supporting surface 174 when the second compression spring 133 is in a relaxed shape. The fixed end 143 of the cantilever 134 attaches to the second pedal 131.

The flush chain 135 is a readily and commercially available chain that provides tensile strength but not compressive strength. Using a flush chain 135 is this manner allows the flush handle 173 to be moved in only one direction thereby reducing inadvertent strain on the internal mechanisms of the toilet 170. The first end 141 of the flush chain 135 attaches to the flush handle 173. The second end 142 of the flush chain attaches to the free end 144 of the cantilever 134.

Figure 6:
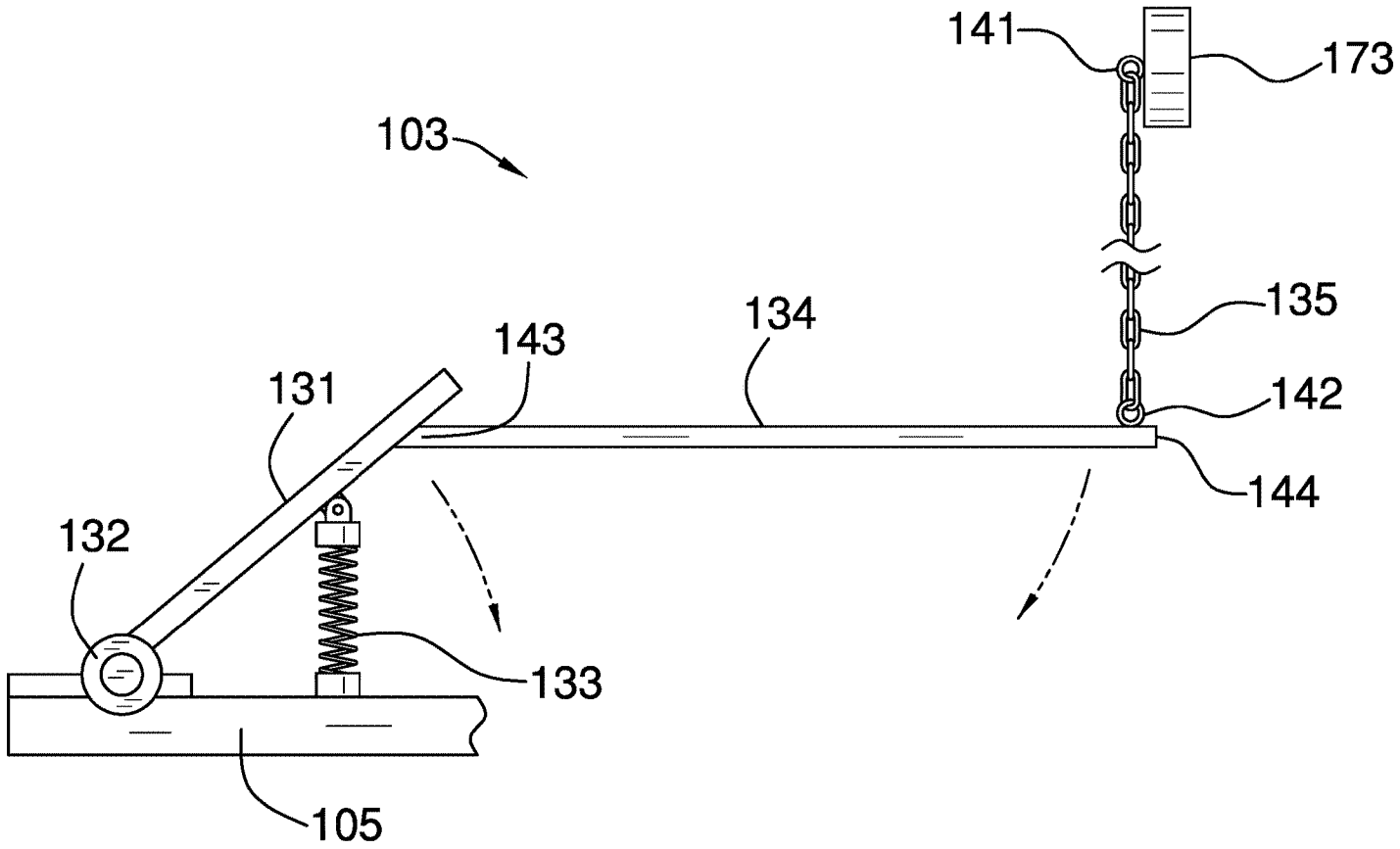
FIG. 6 is a detailed side schematic view of an embodiment of the disclosure.

As shown most clearly in FIG. 6, the second compression spring 133 is mounted between the second pedal 131 and the supporting surface 174 upon which the toilet 170 is placed such that the second compression spring 133 will return the second pedal 131 to its original position once the foot is removed from the second pedal 131.

The operation of the flush mechanism 103 is described in the following two paragraph. The motion of the second pedal 131 towards the supporting surface 174 rotates the cantilever 133 towards the supporting surface 174, which in turn applies a tensile force to the flush chain 135. The motion of the second pedal 131 towards the supporting surface 174 further cause the second compression spring 133 to be depressed which stores mechanical energy within the second compression spring 133. The tensile force applied to the flush chain 135 applies a force to the flush handle 173, which in turn causes the toilet 170 to flush.

When the force causing the motion of the second pedal 131 towards the supporting surface 174 is removed, the energy stored within the second compression spring 133 is released causing the second compression spring 133 to its relaxed state. As the second compression spring 133 returns to its relaxed state, the tensile forces applied to the flush chain 135 are released thereby allowing the flush handle 173 to return to its original position at the end of the flush cycle of the toilet 170.

The following definitions were used in this disclosure:

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Center of Rotation: As used in this disclosure, the center of rotation is the point of a rotating plane that does not move with the rotation of the plane. A line within a rotating three dimensional object that does not move with the rotation of the object is referred to as an axis of rotation.

Chain: As used in this disclosure, a chain is a series of interlinked rings that form a cord like structure. Like a cord, a chain has tensile strength but is too flexible to provide compressive strength and is not suitable for use in pushing objects. The rings to form a chain are often formed from a metal.

Compression Spring: As used in this disclosure, a compression spring is a wire coil that resists forces attempting to compress the wire coil in the direction of the center axis of the wire coil. The compression spring will return to its original position when the compressive force is removed.

Cord: As used in this disclosure, a cord is a long, thin, and flexible piece of string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, and rope are synonyms for cord.

Loop: As used in this disclosure, a loop is the length of a first linear structure including, but not limited to, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Mechanical Linkage: As used in this disclosure, a mechanical linkage is an interconnected arrangement of components that are used to manage the transfer of a movement or a force. A mechanical linkage is often referred to as a linkage.

Pulley: As used in this disclosure a pulley is a wheel with a grooved rim around which a cord (or other form of rope, line, or cable) passes. The pulley is used to change the direction of a force applied to the cord.

Relaxed Shape: As used in this disclosure, a structure is considered to be in its relaxed state when no shear, strain, or torsional forces are being applied to the structure.

Ring: As used in this disclosure, a ring is term that is used to describe a flat or plate like structure through which an aperture is formed. Rings are often considered loops.

Shaft: As used in this disclosure, a shaft is a long, narrow and rigid structure that is used as: 1) a structural element of a larger object; or 2) as a grip or lever for a handle. Shafts are often cylindrical in shape.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An apparatus configured for use with sanitary equipment comprising:

a cover, a lifting mechanism, and a flush mechanism;

wherein the apparatus configured for use with sanitary equipment is configured for use with a toilet;

wherein the toilet is further defined with a toilet seat, a toilet lid, and a flush handle;

wherein the apparatus configured for use with sanitary equipment is a mechanical apparatus wherein the apparatus configured for use with sanitary equipment lifts the toilet seat and the toilet lid;

wherein the apparatus configured for use with sanitary equipment flushes the toilet;

wherein the lifting mechanism allows the toilet seat and the toilet lid to be lifted without the use of hands;

wherein the lifting mechanism lowers the toilet seat and the toilet lid to their original positions after use;

wherein the flush mechanism operates the flush handle without the use of hands;

wherein the cover is a shell that is mounted around the base of the toilet;

wherein the floor panel is a hollow plate structure that is formed to wrap around the toilet;

wherein the floor panel forms a protective shell within which is stored a portion the lifting mechanism;

wherein the lifting mechanism is a pedal operated mechanical device that raises and lowers the toilet seat and the toilet lid;

wherein the flush mechanism is a mechanical apparatus that applies a force to the flush handle of the toilet;

wherein the lifting mechanism comprises a first pedal, a first pedal pivot, a first pedal pulley, a transfer pulley, a drive pulley, an axle pulley, an axle pivot, a plurality of lifting levers, a first belt, a second belt, and a first compression spring;

wherein the first pedal, the first pedal pivot, the first pedal pulley, the transfer pulley, the drive pulley, the axle pulley, the axle pivot, the plurality of lifting levers, the first belt, the second belt, and the first compression spring forms a first mechanical linkage.

2. The apparatus configured for use with sanitary equipment according to claim 1 wherein the plurality of lifting levers attach to the toilet seat.

3. The apparatus configured for use with sanitary equipment according to claim 2 wherein the first pedal is a foot operated lever;

wherein the movement of the first pedal provides the motive force that operates the individual lifting mechanism;

wherein by returning the first pedal to the original position, the toilet seat or the toilet lid is also returned to its original position;

wherein the compression spring provides the motive force to return the first pedal to the original position.

4. The apparatus configured for use with sanitary equipment according to claim 3 wherein the first pedal pivot is a first cylindrical shaft;

wherein the axle pivot is a second cylindrical shaft;

wherein the first pedal pulley is a first pulley;

wherein the transfer pulley is second pulley;

wherein the drive pulley is a third pulley;

wherein the axle pulley is fourth pulley;

wherein each of the plurality of lifting levers is a strut;

the first belt is a first cord;

wherein the second belt is a second cord;

wherein the compression spring is a helical coil compression spring.

5. The apparatus configured for use with sanitary equipment according to claim 4 wherein the first pedal is mounted on the first pedal pivot such that when the first pedal is stepped on the motion of the first pedal will rotate the first pedal pivot;

wherein the first pedal pulley is mounted in a fixed manner to the first pedal pivot;

wherein the first pedal pulley is mounted to the first pedal pivot such that the rotation of the first pedal pivot will rotate the first pedal pulley in the same rotational direction as the first pedal pivot.

6. The apparatus configured for use with sanitary equipment according to claim 5 wherein each of the plurality of lifting levers are attached in a fixed manner to the axle pivot such that the rotation of the axle pivot will cause the plurality of lifting levers to move;

wherein each of the plurality of lifting levers is a strut that projects perpendicularly away from the axle pivot;

wherein each of the plurality of lifting levers attaches to an object selected from the group consisting of the toilet seat or the toilet lid such that the rotation of the axle pivot will raise or lower the selected object.

7. The apparatus configured for use with sanitary equipment according to claim 6 wherein the axle pulley is mounted in a fixed manner to an end of the axle pivot;

wherein the axle pulley is mounted to the axle pivot such that the rotation of the axle pivot will rotate the axle pulley in the same rotational direction as the axle pivot.

8. The apparatus configured for use with sanitary equipment according to claim 7 wherein the first belt is formed into a loop that loops around the first pedal pulley and the transfer pulley such that the rotation of the first pedal pulley will rotate the transfer pulley.

9. The apparatus configured for use with sanitary equipment according to claim 8 wherein the drive pulley attaches to the transfer pulley such that the rotation of the transfer pulley will rotate the drive pulley in the direction of the transfer pulley.

10. The apparatus configured for use with sanitary equipment according to claim 9 wherein the second belt is a cord that is formed into a loop that loops around the drive pulley and the axle pulley such that the rotation of the drive pulley will rotate the axle pulley.

11. The apparatus configured for use with sanitary equipment according to claim 10 wherein the drive pulley and the transfer pulley are mounted on a stand.

12. The apparatus configured for use with sanitary equipment according to claim 11 wherein the compression spring is mounted between the first pedal and a supporting surface upon which the toilet is placed;

wherein the compression spring returns the first pedal to its original position after a motive force is removed from the first pedal.

13. The apparatus configured for use with sanitary equipment according to claim 12 wherein the motion of the first pedal towards the supporting surface rotates the first pedal pivot which in turn rotates the first pedal pulley;

wherein the motion of the first pedal towards the supporting surface further causes the compression spring to be depressed which stores mechanical energy within the compression spring;

wherein the energy of the rotation of the first pedal pulley is transferred to the transfer pulley through the first belt such that the rotation of the first pedal pulley causes the transfer pulley to rotate;

wherein the rotation of the transfer pulley causes the drive pulley to rotate;

wherein the energy of the rotation of the drive pulley is transferred to the axle pulley through the second belt such that the rotation of the drive pulley causes the axle pulley to rotate;

wherein the rotation of the axle pulley causes the axle pivot to rotate;

wherein the rotation of the axle pivot causes the plurality of lifting levers to rotate which in turn causes either the toilet seat or the toilet lid to be lifted.

14. The apparatus configured for use with sanitary equipment according to claim 13 wherein the flush mechanism comprises a second pedal, a second pedal pivot, a second compression spring, a cantilever, and a flush chain;

wherein the second pedal, the second pedal pivot, the second compression spring, the cantilever, and the flush chain forms a second mechanical linkage;

wherein the cantilever is further defined with a fixed end and a free end;

wherein the flush chain is further defined with a first end and a second end.

15. The apparatus configured for use with sanitary equipment according to claim 14 wherein the second pedal is a foot-operated lever;

wherein the movement of the second pedal provides the motive force that operates the flush mechanism;

wherein the second pedal pivot is a cylindrical shaft;

wherein the second pedal is mounted on the second pedal pivot such that when the second pedal is stepped on the second pedal will rotate around the second pedal pivot;

wherein the second compression spring is a helical coil compression spring that is placed underneath the second pedal.

16. The apparatus configured for use with sanitary equipment according to claim 15 wherein the cantilever is a rigid shaft that projects away from the second pedal such that the cantilever is parallel to the supporting surface when the second compression spring is in a relaxed shape;

wherein the fixed end of the cantilever attaches to the second pedal;

wherein the flush chain comprises tensile strength but not compressive strength;

wherein the first end of the flush chain attaches to the flush handle;

wherein the second end of the flush chain attaches to the free end of the cantilever;

wherein the second compression spring will return the second pedal to its original position.

17. The apparatus configured for use with sanitary equipment according to claim 16 wherein the second pedal rotates the free end of the cantilever;

wherein the free end of the cantilever applies a tensile force to the flush chain;

wherein the tensile force applied to the flush chain applies a force to the flush handle;

wherein as the second compression spring returns to its relaxed state, the tensile forces applied to the flush chain are released.

* * * * *